US008230838B2

(12) United States Patent
Clark et al.

(10) Patent No.: US 8,230,838 B2
(45) Date of Patent: Jul. 31, 2012

(54) INJECTOR SEAL ASSEMBLY AND METHOD OF SEALING A COOLANT PASSAGE FROM AN INJECTOR

(75) Inventors: Kent H. Clark, Panama, NY (US); Glen T. Haegele, Columbus, IN (US); Nathan Coulombe, Greenwood, IN (US); Matthew R. Walker, Jamestown, NY (US); John M. Nyvall, Columbus, IN (US); Jeffrey J. Hurd, Columbus, IN (US); Andrew J. Keenan, Columbus, IN (US)

(73) Assignee: Cummins Intellectual Properties, Inc., Minneapolis, MN (US)

( * ) Notice: Subject to any disclaimer, the term of this patent is extended or adjusted under 35 U.S.C. 154(b) by 26 days.

(21) Appl. No.: 12/888,760

(22) Filed: Sep. 23, 2010

(65) Prior Publication Data

US 2011/0067653 A1 Mar. 24, 2011

Related U.S. Application Data

(60) Provisional application No. 61/245,081, filed on Sep. 23, 2009.

(51) Int. Cl.
*F02M 61/14* (2006.01)
*F02M 61/16* (2006.01)

(52) U.S. Cl. ..... 123/470

(58) Field of Classification Search ..... 123/470, 123/41.31, 541; 277/313, 591, 598
See application file for complete search history.

(56) References Cited

U.S. PATENT DOCUMENTS

| | | | | |
|---|---|---|---|---|
| 3,334,617 | A | 8/1967 | Palkowsky | |
| 4,043,160 | A | 8/1977 | Baker et al. | |
| 5,195,362 | A * | 3/1993 | Eason | 73/49.7 |
| 5,345,913 | A * | 9/1994 | Belshaw et al. | 123/470 |
| 6,053,432 | A * | 4/2000 | Stevens | 239/533.2 |
| 6,112,722 | A | 9/2000 | Barnhart et al. | |
| 6,119,658 | A | 9/2000 | Jehle et al. | |
| 6,279,516 | B1 * | 8/2001 | Haugen et al. | 123/41.82 R |
| 6,481,421 | B1 | 11/2002 | Reiter | |
| 6,866,026 | B2 * | 3/2005 | Mickelson | 123/470 |
| 6,892,707 | B2 | 5/2005 | Reiter et al. | |
| 7,028,918 | B2 * | 4/2006 | Buchanan et al. | 239/132.3 |
| 7,261,089 | B2 | 8/2007 | Hoenig et al. | |
| 2004/0060544 | A1 * | 4/2004 | Reiter et al. | 123/470 |
| 2008/0271713 | A1 | 11/2008 | Morris | |

FOREIGN PATENT DOCUMENTS

| | | |
|---|---|---|
| JP | S59-184366 U | 12/1984 |
| JP | 2000-170627 A | 6/2000 |

OTHER PUBLICATIONS

The International Search Report and the Written Opinion of the International Searching Authority with mailing date of Apr. 28, 2011; International Application No. PCT/US2010/049960.

* cited by examiner

*Primary Examiner* — Mahmoud Gimie
(74) *Attorney, Agent, or Firm* — Studebaker & Brackett PC; Tim L. Brackett, Jr.

(57) ABSTRACT

An injector seal assembly and method of sealing a coolant passage from an injector are provided. The seal assembly includes a sealing sleeve sized and dimensioned to slip fit into an injector mounting bore and a retaining ring sized and dimensioned to be axially inserted into the sleeve. The ring contacts the sleeve and applies a radial force sufficient to create an interference fit and to move or yield an interface portion of the sleeve radially outward into sealing abutment against a wall forming the injector mounting bore to create a secure and reliable annular fluid seal.

18 Claims, 4 Drawing Sheets

INJECTOR SEAL ASSEMBLY AND METHOD OF SEALING A COOLANT PASSAGE FROM AN INJECTOR

TECHNICAL FIELD

These inventions relate to the sealing of a coolant passage from a fuel injector.

BACKGROUND

An internal combustion engine with a fuel injector may require a separate injector sleeve insert to separate coolant from the fuel injector. Many designs for injector sleeve insertion exist with varying degrees of robustness against coolant, fuel, and combustion gas, leaks, particularly at the end closest to the combustion event, i.e. the combustion chamber. The high local temperatures make elastomeric sealing a challenge. Also, high mechanical and thermal load cycling may create high stress at the sleeve/head seal interface. Various conventional sleeve and cylinder head designs possess various complexities in the cylinder head to satisfy long term cylinder head durability requirements, and these complexities sometimes involve expensive details requiring tight tolerance and process controls.

SUMMARY OF THE INVENTIONS

The embodiments consistent with the claimed inventions include an injector seal assembly for insertion in a mounting bore formed in a portion of an engine, comprising a sealing sleeve including an outer surface sized and dimensioned to be positionable in the mounting bore adjacent a bore sealing surface. The sealing sleeve further includes an inner surface and a ring interface portion. The inner surface at the interface portion has an inner radial extent. The seal assembly also includes a retaining ring sized and dimensioned to be positionable within the sleeve adjacent the ring interface portion. The retaining ring has an outer annular surface with an outer radial extent greater than the inner radial extent of the inner surface at the interface portion of the sealing sleeve to apply a radially outward sealing force against the interface portion to create a fluid seal between the sealing sleeve and the bore sealing surface.

The outer surface of the sealing sleeve may be sized and dimensioned to not form a fluid seal against the bore sealing surface without the radially outward sealing force. The sealing sleeve may be formed of a first material and the retaining ring may be formed of a second material different than the first material. The first material may be resistant to corrosion. The second material may have thermal expansion characteristics at least comparable to a material forming the portion of the engine. The outer surface of the sealing sleeve at the interface portion may be devoid of one or more grooves. The sealing sleeve may be an annular groove formed in the outer surface and positioned at a spaced axial distance from the interface portion. The interface portion may have a radial width greater than a portion of the sealing sleeve adjacent the interface portion.

Embodiments consistent with the claimed inventions also include a method of sealing a coolant passage from an injector, comprising providing an injector mounting bore, providing a coolant passage in communication with the injector mounting bore, positioning a sealing sleeve in the mounting bore, positioning a retaining ring in the mounting bore and within the sleeve, and applying an axial force to the retaining ring to cause the retaining ring to apply a radial force against the sealing sleeve to cause the sealing sleeve to sealingly abut a sealing surface in the mounting bore to create a fluid seal between the sealing sleeve and the sealing surface to seal a portion of the coolant passage from the mounting bore. The method may further include inserting a fuel injector into the mounting bore and the sealing sleeve while maintaining the retaining ring in the sealing sleeve. The sealing sleeve may include an interface portion having an outer surface to sealingly abut the sealing surface. The positioning of the sealing sleeve in the mounting bore may not form a fluid seal between the outer surface of the interface portion and the sealing surface.

Embodiments consistent with the claimed inventions also include an engine comprising an injector mounting bore including a sealing surface, a sealing sleeve positioned in the injector mounting bore, a retaining ring mounted in the sealing sleeve and sized to apply a radially outward sealing force against the sealing sleeve to create a fluid seal between the sealing sleeve and the sealing surface, and an injector mounted in the mounted bore adjacent the retaining ring. The sealing sleeve may include an inner sleeve surface having an inner radial extent. The retaining ring may have an outer ring surface with an outer radial extent greater than the inner radial extent of the inner sleeve surface of the sealing sleeve to create an interference fit. The engine may further include a coolant passage in communication with the mounting bore, and an annular seal positioned between the sealing sleeve and the sealing surface. The sealing sleeve may include an interface portion in contact with the retaining ring. The coolant passage may be positioned axially along the injector between the interface portion and the annular seal. The sealing sleeve may include an interface portion in contact with the retaining ring. The interface portion may have a radial width greater than a portion of the sealing sleeve adjacent the interface portion. The engine may further include a coolant passage in communication with the mounting bore. The fluid seal may fluidically seal a portion of the coolant passage from the mounting bore.

DETAILED DESCRIPTION

Figure 1:
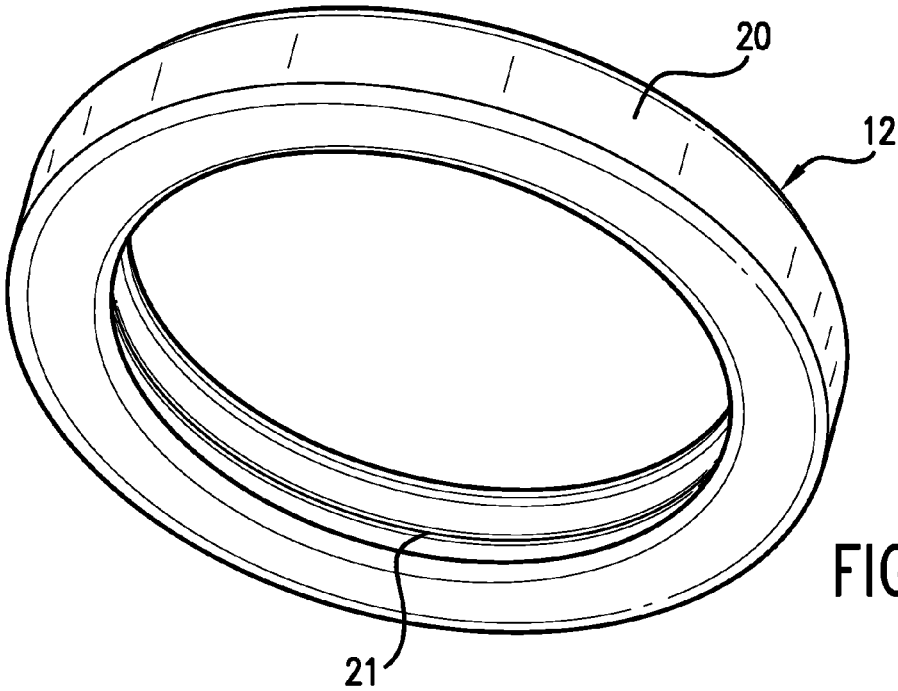
FIG. 1 is a perspective view of an exemplary embodiment of the retaining ring of the seal assembly.

An exemplary embodiment of the sealing assembly, indicated generally at 10 in FIGS. 3*a*-3*d*, includes an expansion or retaining ring 12 and an injector or sealing sleeve 14 for positioning in a fuel injector mounting bore 16 formed in a portion, i.e. cylinder head, 18 of an internal combustion engine. Cylinder head 18 includes a coolant passage 32 in communication with or fluidly connected to mounting bore 16 prior to insertion of seal assembly 10. Coolant passage 32 is simply, easily and reliably fluidly sealed from the mounting bore to isolate the coolant from the injector by insertion of seal assembly of 10. Sealing assembly 10 provides a metal to metal combustion deck side seal with contact pressures high enough to yield sealing sleeve 14 into sealing abutment against the opposing surface of the engine forming injector mounting bore 16, and then maintain that contact pressure without requiring augmentation from the injector mounting or securement system. That is, the injector clamping or securing load, for securing the fuel injector 19 in mounting bore 16, is not relied upon to apply a sealing force to sealing sleeve 14.

Referring to FIG. 1, retaining ring 12 is sized, dimensioned, and formed of an appropriate material, so that simply by pressing the ring into position, a high sealing interface pressure is created between sealing sleeve 14 and mounting bore 16. Retaining ring 12 is circular in shape with a hollow center and includes an outer annular surface 20 for contacting sealing sleeve 14. In the exemplary embodiment of FIG. 1, outer annular surface 20 is generally a continuous curved surface free of grooves. In other embodiments, outer annular surface 20 may have grooves or projections so long as the outermost annular surface contacts sealing sleeve 14 sufficiently around the sleeve's inner circumference to apply sufficient radial pressure or force to the sleeve to create a complete fluid seal between sealing sleeve 14 and cylinder head 18 around the entire circumference of sleeve 14. Retaining ring 12 also includes a feature to allow removal of ring 12 during a potential reconditioning event. The removal feature is preferably an annular groove 21 formed on the inner surface of ring 12, but two or more spaced depressions may be used, for grasping by a tool.

Figure 2:
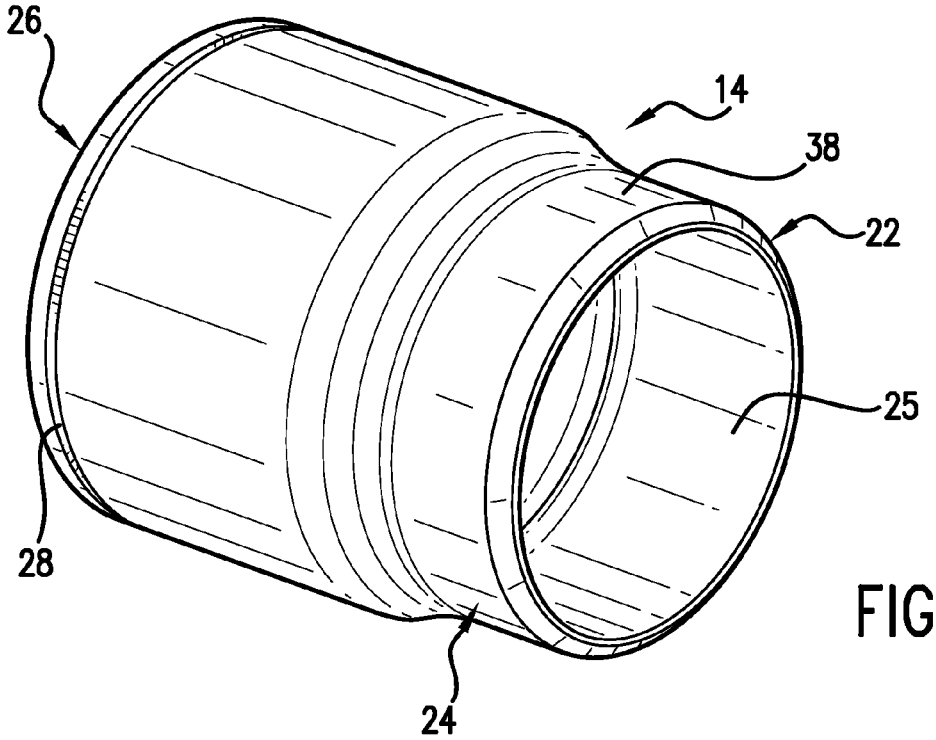
FIG. 2 is a perspective view of an exemplary embodiment of the sealing sleeve of the seal assembly.
Figure 3A:
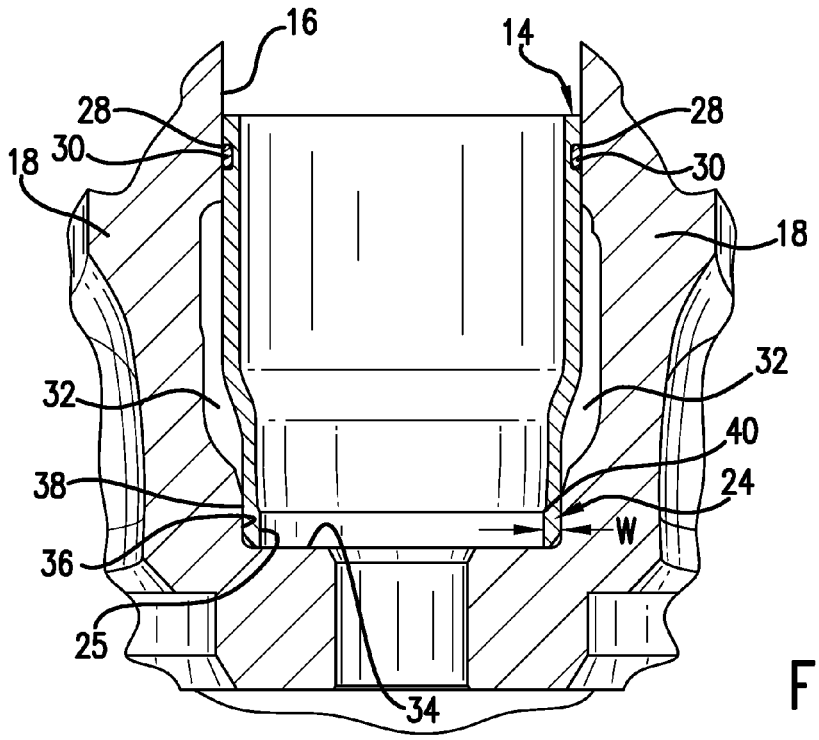
FIG. 3*a* is a cross-sectional view of the sealing sleeve inserted into position in an engine mounting bore.
Figure 4:
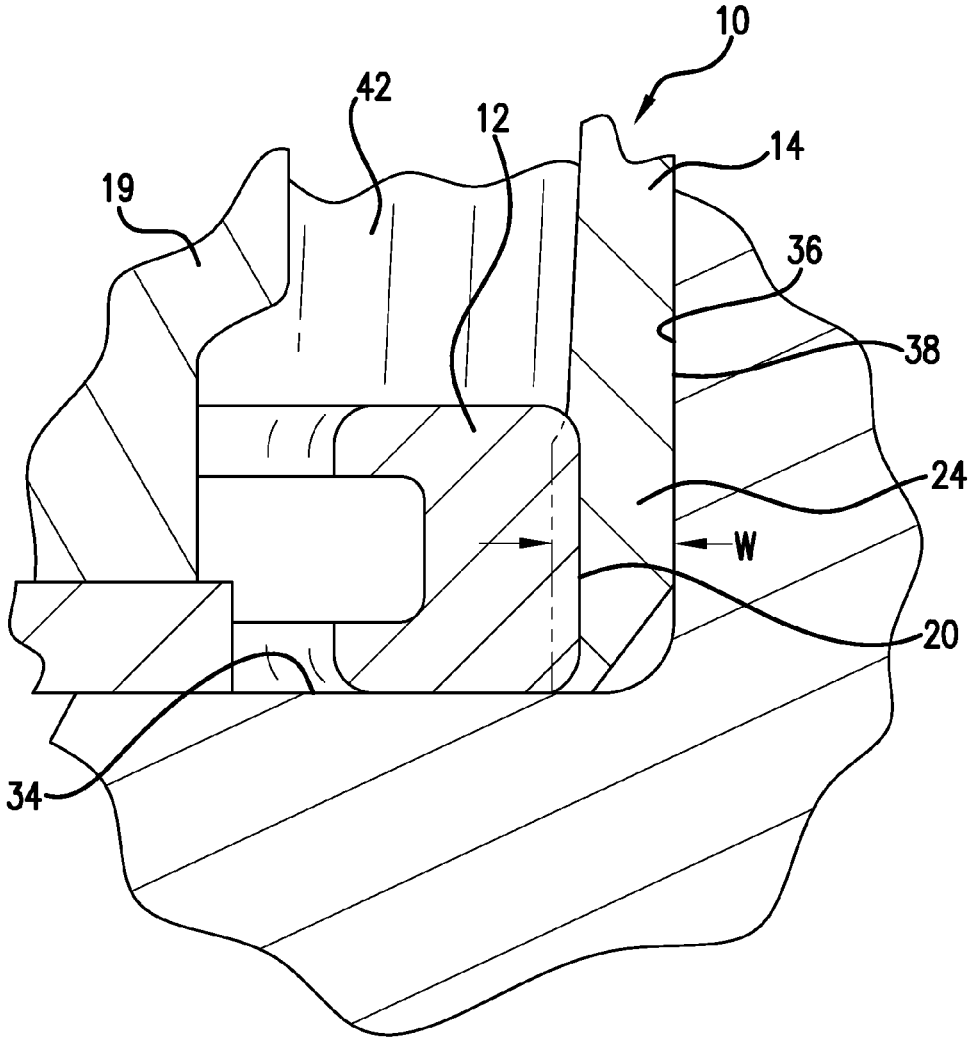
FIG. 4 is an enlarged cross-sectional view of a portion of the seal assembly installed as shown in FIG. 3*d*.

Referring to FIG. 2, sealing sleeve 14 is sized, dimensioned, and formed of an appropriate material, to be slip fit into place in injector mounting bore 16 formed in cylinder head 18. Sealing sleeve 14 is generally cylindrical or tubular in shape and includes an inner end 22, an interface portion 24 formed at inner end 22, an outer end 26, and an annular groove 28 formed at outer end 26 for receiving a seal ring 30 (FIG. 3*a*). In other embodiments, annular groove 28 and seal ring 30 may be omitted or replaced with a series of swallow grooves to enhance plasticity of the sleeve outer surface. Whether or not the groove and seal ring are present, outer end 26 may be sealed by plastically rolling outer end 26 radially outward into the cylinder head wall forming the bore using an conventional rolling device. Sealing sleeve 14 is sized with an appropriate diameter along its length to create a close sliding fit with the portion of the engine, i.e. cylinder head, 18 forming bore 16. In the exemplary embodiment, the lower portion of the sleeve 14 has a smaller diameter than the upper portion. In other embodiments, sleeve 14 may be a simple cylinder. As best shown in FIGS. 3*a* and 4, interface portion 24 has a radial width or wall thickness W greater than an adjacent portion of the wall of sealing sleeve 14. Interface portion 24 includes an inner surface 25 having a radial extent less than a radial extent of outer annular surface 20 of retaining ring 12, or in other words, outer annular surface 20 has a greater radial extent than the inner radial extent of inner surface 25, to create an interference fit upon assembly. In the exemplary embodiment, the outer diameter of ring 12 is greater than the inner diameter of the interface portion 24 of sleeve 14 causing the retaining ring 12 to abut sleeve 14 during insertion and impart a radially outward force against interface portion 24 to cause interface portion 24 to bend or yield slightly radially outward into sealing abutment against cylinder head 18. Inner surface 25 of interface portion 24 may be formed on an inner land or protrusion 40. In the exemplary embodiment, land 40 extends continuously around the inner circumference of sleeve 14. However, in other embodiments, land 40 may extend around only a portion of the circumference, e.g., land 40 may be a plurality of spaced protrusions, so long as the sealing pressure is continuous and substantially uniform circumferentially.

Figure 3B:
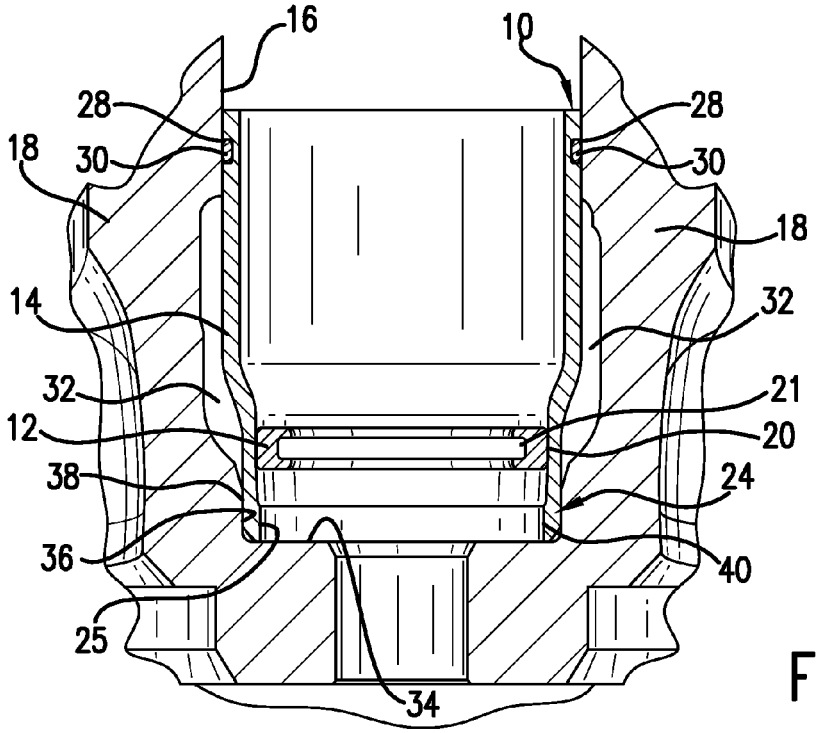
FIG. 3*b* is a cross-sectional view of the sealing sleeve in position in the mounting bore and the retaining ring being moved into position.
Figure 3C:
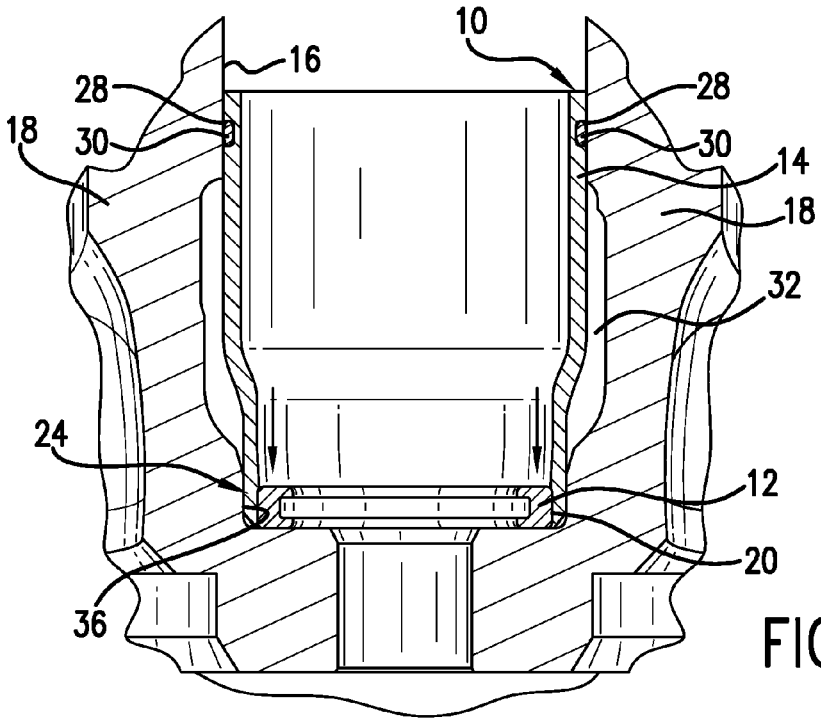
FIG. 3*c* is a cross-sectional view of the seal assembly installed in position in a mounting bore.

Referring to FIGS. 3*a*-3*d* and 4, sealing sleeve 14 is inserted into mounting bore 16 until inner end 22 abuts an annular bore land 34 formed on cylinder head 18 within mounting bore 16 and extending transverse to the longitudinal axis of mounting bore 16. Cylinder head 18 also includes a bore sealing surface 36 extending along the longitudinal axis of mounting bore 16 and, in the exemplary embodiment, extends parallel to the longitudinal axis. Interface portion 24 includes an outer annular surface 38 positioned in close sliding relationship with bore sealing surface 36, without creating a complete fluid seal, when sealing sleeve 14 is inserted into bore 16 in the position shown in FIG. 3*a* prior to insertion of retaining ring 12. Retaining ring 12 is then inserted into mounting bore 16 and into sleeve 14 as shown in FIG. 3*b*. Ring 12 is pressed or forced to the bottom of mounting bore 16 into a seated position against bore land 34 by, for example, an insertion tool (not shown). The pressing action or downward force, shown as arrows A in FIG. 3*c*, axially downwardly on ring 12 causes ring 12 to impart an outwardly radial force or contact pressure on sealing sleeve 14 causing sleeve 14 to yield and move slightly outwardly. Interface portion 24 is not only moved slightly to close any existing tolerance gap but also is crushed or yields. FIG. 4 shows the inner surface 24 (land 40) as a dashed line as it was prior to expansion/yielding by ring 12. As a result, outer annular surface 38 of interface portion 24 sealingly contacts or abuts bore sealing surface 36 to create a continuous annular interface seal around the entire mounting bore 16. Outer surface 38 may include surface formations, such as very small grooves, to promote plasticity of the sleeve into sealing contract with bore sealing surface 36. The relative material hardness of the sealing sleeve 14 and retaining ring 12 at the seal region or interface, along with the interference fit, i.e. relative diameters of the inner surface of the sleeve and the outer surface of the ring, determines the yielding of the sleeve 14. The interface pressure at the seal between outer surface 38 of sleeve 14 and bore sealing surface 36 is controlled by both the amount or degree of interference between outer surface 20 of ring 12 and inner surface 25 of sleeve 14, and the initial "slip fit" gap or distance between outer surface 38 of sleeve 14 and bore sealing surface 36. The interference (INT) may be stated as follows:

$$INT = ID - OD - (2 \times W)$$

Where: ID=Mounting bore 16 inner diameter at bore sealing surface 36; OD=Retaining ring 12 outer diameter; W=Radial wall thickness of sealing sleeve at sealing region.

Figure 3D:
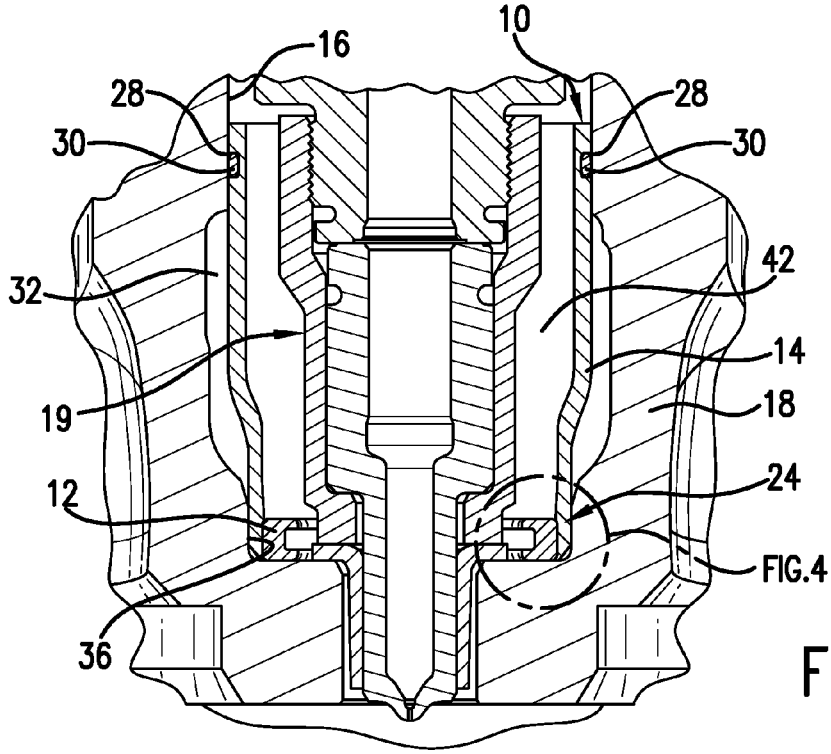
FIG. 3*d* is a cross-sectional view of the sealing assembly installed in position and an injector mounted in the mounting bore and sealing sleeve adjacent the retaining ring.

Lastly, as shown in FIG. 3*d*, fuel injector 19 is mounted in mounting bore 16 using any conventional mounting system. The mounting of the injector 19 creates an annular chamber 42, usually filled with fuel at low pressure. Sealing assembly 10 successfully and effectively fluidly separates chamber 42 from coolant passage 32 by the interference type annular lower seal and the upper seal provided by seal ring 30. Sealing assembly 10 does not rely on any mounting clamp load from the injector, or any force on ring 12 by the injector, to initiate the sealing effect of ring 12, and does not require a force from the injector or any other component to maintain the pressure on sleeve 14. Sealing assembly 10 does not require the injector to be present to maintain the coolant seal since the injector and retaining ring never come into contact with each other, i.e. remain a spaced distance from one another.

It should be noted that retaining ring 12 is left in place in bore 16, after insertion and expansion of the wall of sleeve 14 to maintain contact pressure on sleeve 14 so that sleeve 14 maintains sealing pressure against bore sealing surface 36 of cylinder head 18 throughout engine operation. Sealing assembly 10 and the sealing method offers the ability to use different materials for sleeve 14 and ring 12 to tailor the material requirements to the function of each part. Retaining ring 12 does not function as a sealing element. Instead, retaining ring 12 first mechanically expands the deformable sleeve material, and then is left in place during engine operation to maintain the contact pressure during the thermal expansion and contraction experienced during engine operation. The retaining ring material may have the same thermal expansion characteristics as the base cylinder head material to reduce the potential for leakage during engine operation. Thus, sealing sleeve 14 and retaining ring 12 may be formed of different materials to balance the requirements of sealing sleeve corrosion against seal and contact pressure limits during cyclic thermal events. Sealing sleeve 14 can be made of a corrosion resistant material, such as stainless steel, whereas retaining ring 12 can be made of a material having thermal growth or expansion characteristics comparable to, substantially the same as, or identical to, the base cylinder head material, such as low carbon steel.

Thus, sealing assembly 10 and the associated method avoids costly component features, costly tolerances, and costly process controls by letting material properties control the sealing interface pressure and by reducing the installation event to a simple mechanical press. Sealing assembly and method 10 offers a convenient, simple and cost effective way of achieving a secure, reliable, and complete annular fluid seal to ensure coolant is prevented from reaching fuel in an injector mounting bore.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

We claim:

1. An injector seal assembly for insertion in a mounting bore having a longitudinal axis formed in a portion of an engine, comprising:

a sealing sleeve including an outer surface sized and dimensioned to be positionable in the mounting bore adjacent a bore sealing surface, said sealing sleeve further including an inner surface and a ring interface portion, said inner surface at, said interface portion having an inner radial extent; and a retaining ring sized and dimensioned to be positionable within said sleeve adjacent said ring interface portion, said retaining ring having an outer annular surface with, in a plane perpendicular to the longitudinal axis, an outer radial extent greater than said inner radial extent of said inner surface at said interface portion of said sealing sleeve to apply a radially outward sealing force against said interface portion to create a fluid seal between said sealing sleeve and the bore sealing surface.

2. The injector seal assembly of claim 1, wherein said outer surface of said sealing sleeve is sized and dimensioned to not form a fluid seal against said bore sealing surface without said radially outward sealing force.

3. The injector seal assembly of claim 1, wherein said sealing sleeve is formed of a first material and said retaining ring is formed of a second material different than said first material, said first material being resistant to corrosion.

4. The injector seal assembly of claim 2, wherein said second material has thermal expansion characteristics at least comparable to a material forming said portion of the engine.

5. The injector seal assembly of claim 1, wherein said outer surface of said sealing sleeve at said interface portion is devoid of one or more grooves.

6. The injector seal assembly of claim 1, wherein said sealing sleeve includes an annular groove formed in said outer surface and positioned at spaced axial distance from said interface portion.

7. The injector seal assembly of claim 1, wherein said interface portion has a radial width greater than a portion of said sealing sleeve adjacent said interface portion.

8. A method of sealing a coolant passage from an injector, comprising:

providing an injector mounting bore;

providing a coolant passage in communication with said injector mounting bore;

positioning a sealing sleeve in, said mounting bore;

positioning a retaining ring in said mounting bore and within said sleeve;

applying an axial force to said retaining ring prior to inserting an injector into said mounting bore to cause said retaining ring to apply a radial force against said sealing sleeve to cause said sealing sleeve to sealingly abut a sealing surface in said mounting bore, to create a fluid seal between said sealing sleeve and, said sealing surface to seal a portion of said coolant passage from said mounting bore; and inserting the fuel injector into said mounting bore and said sealing sleeve while maintaining said retaining ring in said sealing sleeve.

9. The method of claim 8, wherein said sealing sleeve is formed of a first material and said retaining ring is formed of a second material different than said first material, said first material being resistant to corrosion.

10. The method of claim 9, wherein said second material has thermal expansion characteristics at least comparable to a material forming said wall.

11. The method of claim 8, wherein said sealing sleeve includes an interface portion having an outer surface to sealingly abut said sealing surface, said positioning of said sealing sleeve in said mounting bore not forming a fluid seal between said outer surface of said interface portion and said sealing surface.

12. An engine, comprising:

an injector mounting bore including a sealing surface;

a sealing sleeve positioned in said injector mounting bore;

a retaining ring mounted in said sealing sleeve, said retaining ring sized to apply a radially outward sealing force against said sealing, sleeve to create a fluid seal between said sealing sleeve and said sealing surface; and an injector mounted in said mounting bore adjacent, and free of any contact with, said retaining ring.

13. The engine of claim 12, wherein said sealing sleeve includes an inner sleeve surface having an inner radial extent, said retaining ring having an outer ring surface with an outer radial extent greater than said inner radial extent of said inner sleeve surface of said sealing sleeve to create an interference fit.

14. The engine of claim 12, wherein said sealing sleeve is formed of a first material and said retaining ring is formed of a second material different than said first material, said first material being resistant to corrosion.

15. The engine of claim 14, wherein said second material has thermal expansion characteristics at least comparable to a material forming said portion of the engine.

16. The engine of claim 12, wherein the engine further, includes a coolant passage in communication with said mounting bore; and an annular seal positioned between said sealing sleeve and the sealing surface, said sealing sleeve including an interface portion in contact with said retaining ring, said coolant passage positioned axially along said injector between said interface portion and said annular seal.

17. The engine of claim 12, wherein said sealing sleeve includes an interface portion in contact with said retaining ring, said interface portion having a radial width greater than a portion of said sealing sleeve adjacent said interface portion.

18. The engine of claim 12, wherein the engine further includes a coolant passage in communication with said mounting bore, said fluid seal fluidically sealing a portion of said coolant passage from said mounting bore.

* * * * *